US007601083B1

(12) United States Patent
Heald et al.

(10) Patent No.: US 7,601,083 B1
(45) **Date of Patent: *Oct. 13, 2009**

(54) BAT WITH INTERCHANGEABLE SECTIONS

(75) Inventors: Jess H Heald, Tullahoma, TN (US); Jared J. Smalley, Jr., Tullahoma, TN (US); Louis J. Fezio, Vashon, WA (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/938,245

(22) Filed: Nov. 9, 2007

Related U.S. Application Data

(63) Continuation of application No. 11/332,896, filed on Jan. 17, 2006, now Pat. No. 7,311,620.

(51) Int. Cl.
*A63B 59/06* (2006.01)

(52) U.S. Cl. ..... 473/566; 473/567

(58) Field of Classification Search ..... 473/457, 473/519, 520, 564–568
See application file for complete search history.

(56) References Cited

U.S. PATENT DOCUMENTS

| | | | | |
|---|---|---|---|---|
| 3,877,698 | A | 4/1975 | Volpe | |
| 3,955,816 | A | 5/1976 | Bratt | |
| 4,907,800 | A | 3/1990 | Passamaneck et al. | |
| 5,219,164 | A | 6/1993 | Peng | |
| 5,409,214 | A | 4/1995 | Cook | |
| 5,820,438 | A | 10/1998 | Horton, III | |
| 6,099,422 | A | 8/2000 | Rappaport et al. | |
| 6,432,006 | B1 | 8/2002 | Tribble | |
| 6,511,392 | B1 | 1/2003 | Chohan | |
| 6,609,984 | B1 | 8/2003 | Tribble | |
| 6,878,080 | B2 | 4/2005 | Chang | |
| 7,311,620 | B1 * | 12/2007 | Heald et al. | 473/566 |
| 2003/0069095 | A1 | 4/2003 | Turos | |
| 2004/0224801 | A1 | 11/2004 | Forsythe et al. | |
| 2004/0224802 | A1 | 11/2004 | Forsythe et al. | |
| 2004/0224803 | A1 | 11/2004 | Forsythe et al. | |
| 2005/0202908 | A1 | 9/2005 | Haynes | |
| 2006/0252586 | A1 | 11/2006 | Nguyen | |

* cited by examiner

*Primary Examiner*—Mark S Graham
(74) *Attorney, Agent, or Firm*—Waddey & Patterson, P.C.; Phillip E. Walker

(57) ABSTRACT

A bat having interchangeable sections comprising a handle section and a hollow striking section. The handle section includes a first end and a second end, while the hollow striking section includes a tapered portion and a barrel portion. The second end of the handle section is removably attached within the tapered portion. Additionally, the barrel portion includes a length having a mid-point wherein the second end of the handle section terminates before the midpoint of the length of the barrel portion.

4 Claims, 9 Drawing Sheets

BAT WITH INTERCHANGEABLE SECTIONS

CROSS-REFERENCES TO RELATED APPLICATIONS

This application is a continuation of co-pending U.S. patent application Ser. No. 11/332,896 filed Jan. 17, 2006, entitled "Bat with Interchangeable Sections" which is incorporated by reference.

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications described or discussed herein are hereby incorporated by reference in their entirety.

BACKGROUND OF THE INVENTION

The present invention relates generally to an implement used for playing diamond sports. More particularly, the current invention relates to a bat having interchangeable handles and barrels.

It will be appreciated by those of ordinary skill in the art that in the diamond sports, high performance bats are highly desirable. These high performance bats can vary in characteristics and can include numerous expensive parts and be themselves an expensive implement. It will also be appreciated that the specific bat that provides the best performance for a particular individual can vary for individual players of the diamond sports. For example, each participant can vary in specific skill level, weight, strength, height, and dexterity. Additionally, the in specific dimensions of the field being played upon as well as the particular ball being used during the diamond sport can also vary. As such, various bat characteristics can be altered to provide a higher performance bat for those specific sets of circumstances. For example, the weight of the bat, the length of the bat, the weight distribution, the material comprising the bat, the specific configuration of the bat, including multiple wall configurations, and other bat specifics can vary the performance of the bat in a given users hands. Other external sources such as the climate in which the bat is utilized can also vary a bat's performance. As such, an individual player may own numerous styles and types of bats in order to attempt to maximize the overall grouping of factors to provide the highest performance of a bat under a given set of circumstances.

Additionally, various regulatory bodies of the diamond sports have varying performance standards and bat specifications which must be met in order for the bat to be eligible within that association. Players also prefer to use varying bats for various situations. For example, player sometimes prefer to use one bat for practice and a different bat during a game. This can maintain the life of or extend the longevity in the bats used in game situations and can enhance various batting skills. For example, a practice bat could be heavier in order to build strength during the practice sessions and be able to better withstand the higher number of impacts normally experienced during a practice session.

It should be appreciated by one of ordinary skill in the art that the various parts of a bat have different wear characteristics. The various sections of a bat will experience various levels of fatigue for various reasons during the lifespan of a bat. For example, the ball striking portion of the bat experiences compressive stresses and deflections when contacting the ball. Over time, the stresses and deflections create deformations in the barrel, which causes failure. However, usually in this situation the transition portion or handle portion of the bat is still in proper working condition and could be reused if the barrel could be replaced.

As such, there have been several prior attempts to provide bats having separable parts, namely separable handles and barrels, to meet this need. Unfortunately, these prior art attempts have adversely affected the performance of the bat and have used complicated techniques in order to try and reach a proper interchangeable bat. For example, U.S. Pat. Nos. 5,409,214, 6,511,392, 6,432,006, 5,820,438, 4,907,800, 3,955,816, 6,609,984, and 3,877,698 and U.S. Patent Application Publication No. U.S. 2003/0069095 discloses various prior attempts to create a bat with interchangeable sections. These prior art patents and publications used direct threadable attachments between the various sections of the bat in order to secure the sections together. In this construction, the threaded portions will be the weakest sections of the bat and will result in failure at these threads. Additionally, most of these prior art items use very short threaded dowels or bolts in order to attempt to achieve a proper connection. The use of these short threaded items makes it difficult to achieve a proper connection between the elements of the bat and performance of the bat. These threads also add much to the overall cost of the product and will be subject to most of the wear on the bat resulting in most of the failures in the bat. Additionally, other features, such as a shell, are practically inoperatable with these prior art bats.

United States Patent Application Publication numbers 2004/0224801 and 2004/0224802 and 2004/0224803 attempts to provide a bat with interchangeable sections. These patent application publications also disclose numerous bats having internal threading used to hold all the various parts together. Additionally these bats have the handle portion of the bat extending completely through the barrel and attached to the end cap on the opposite end of the barrel. This configuration adds additional cost to the bat as well as lessens the overall performance of the bat due to the inadequacies in the weight, momentum, and bending characteristic of these prior art bats.

What is needed then is a bat with an interchangeable handle and interchangeable barrel that maintains a high level of performance and reduces the overall cost of the bat. This needed bat should provide adequate connection between the individual sections or parts of the bat while facilitating an easy disassemblement of the bat. This needed bat can allow the user of the bat to change the parts of the bat to vary the materials used, weight of the bat, size of the bat, and grip of the bat. This needed bat should provide the capability for multiple interchangeable barrels and handles that will conform to the specifications required by the governing bodies of the sport to which they are used while providing for the rotation of barrels used in game and practice situations. This needed bat is lacking in the art.

BRIEF SUMMARY OF THE INVENTION

The present invention discloses a bat having interchangeable sections. The bat comprises a handle section and a hollow striking section. The handle section includes a first end and a second end, while the hollow striking section includes a tapered portion and a barrel portion. The second end of the handle section is removably attached within the tapered portion. Additionally, the barrel portion includes a length having a mid-point wherein the second end of the handle section terminates before the midpoint of the length of the barrel portion.

A fastening member can be positioned in the tapered portion and a connecting element can be positioned on the second end of the handle section. The connecting element engages the fastening member and removably attaches the hollow striking section to the handle section. A basing member can be positioned on the handle section proximate to the second end to axially deflect the handle section relative to the tapered portion.

In a preferred embodiment, the connecting element includes a collar, an extension, and an expanded head. The collar, the expanded head, and the extension, or neck, each include a perimeter and the perimeter of the collar and the perimeter of the expanded head is larger than the perimeter of the extension.

The fastening member includes proximal and distal ends. The proximal end is positioned between the first end of the handle section and the distal end of the fastening member. The transition portion includes a circumferential face and the proximate end can be positioned inset from the circumferential face. Alternately, the proximate end can be positioned substantially flush with the circumferential face. The distal end includes notched sidewalls defining a slotted opening rotatively fixing the connection element with respect to the fastening members. Specifically, the expanded head and extension of the connecting element can pass through the slotted opening of the distal end of the fastening member. The expanded head connecting element can then be rotated to where the expanded head is aligned with the notched sidewalls such that the expanded head can engage, or sit in, the notched sidewalls. This effectively restricts the connecting element from rotating with respect to the fastening member.

The fastening member can be tapered and frictionally fixed within the transition portion. The transition portion includes a narrowing internal circumference, which can also be described as a narrowing internal radius, positioned distal from the barrel portion. The fastening member includes a narrowing external circumference corresponding to the narrowing internal circumference of the transition portion. As such, the fastening member is shaped to sit within the transition portion and correspond to the internal slope and shape of the transition portion.

The barrel portion can be inseparable from the transition portion such that when the connecting element is removably fixed to the fastening member, the fastening member being fixed to the transition portion, the handle section and striking section are in a fixed relationship to one another. Additionally, a biasing member can engage the circumferential face of the tapering portion to tighten the securement between the handle section and the striking section by axially repositioning the handle section with respect to the striking section.

It is therefore a general object of the present invention to provide a bat having interchangeable sections.

Another object of the present invention is to provide a bat having a handle section removably secured to a tapered portion of a striking section of the bat.

Another object of the present invention is to provide a bat having a handle section that internally terminates before the midpoint of a barrel portion of the bat.

Still another object of the present invention is to provide a bat having a fastening member positioned in a tapered portion of the striking section of the bat where the fastening member removably attaches the striking section of the bat to the handle section of the bat.

Other and further objects, features and advantages of the present invention will be readily apparent to those skilled in the art upon reading of the following disclosure when taken in conjunction with the accompanying drawings.

DETAILED DESCRIPTION OF THE INVENTION

Figure 1:
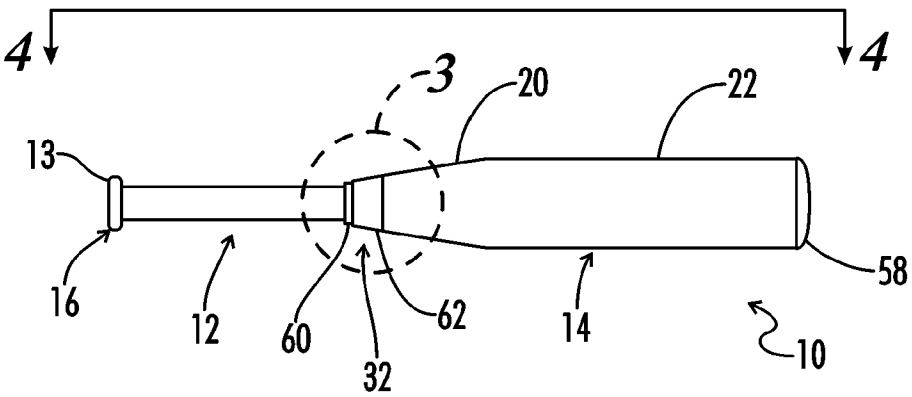
FIG. 1 is a side view of one embodiment of a bat made in accordance with the current invention.
Figure 2:
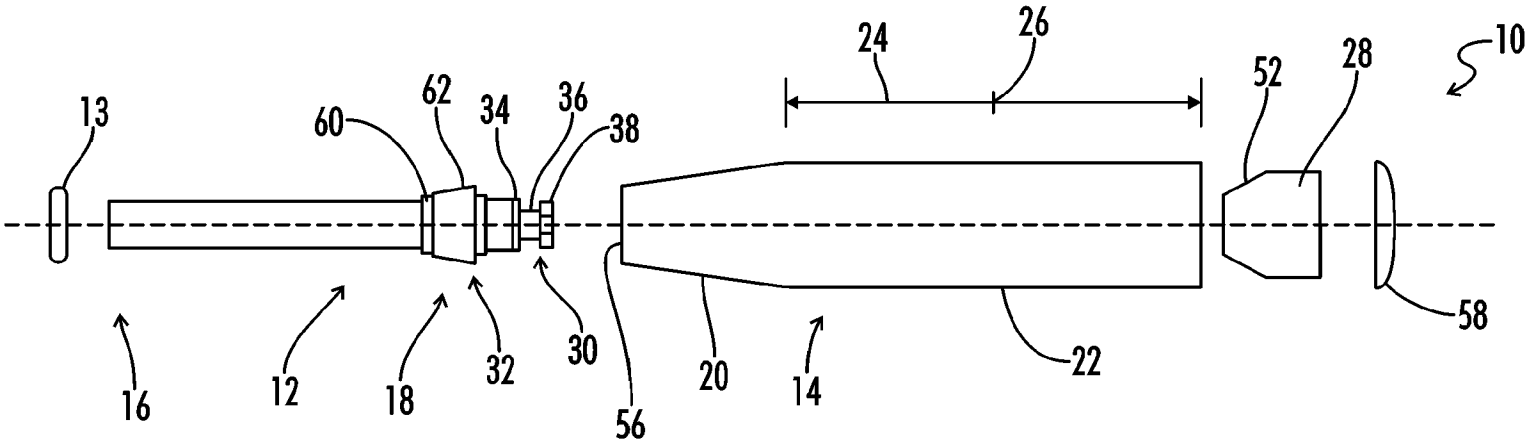
FIG. 2 is an expanded view of the bat shown in FIG. 1.
Figure 3:
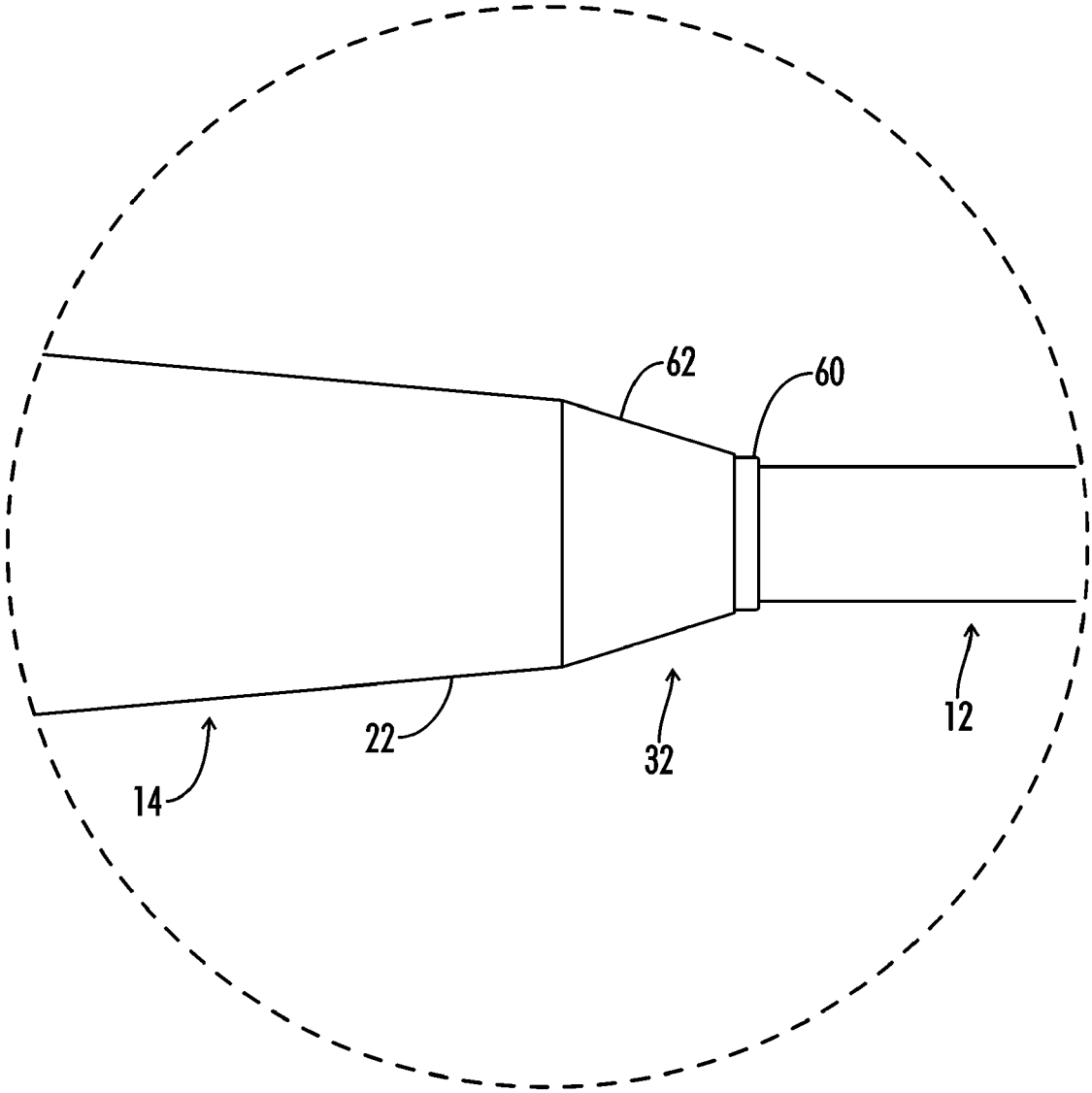
FIG. 3 is a detailed view of the area of the bat indicated as region 3 in FIG. 1.
Figure 4:
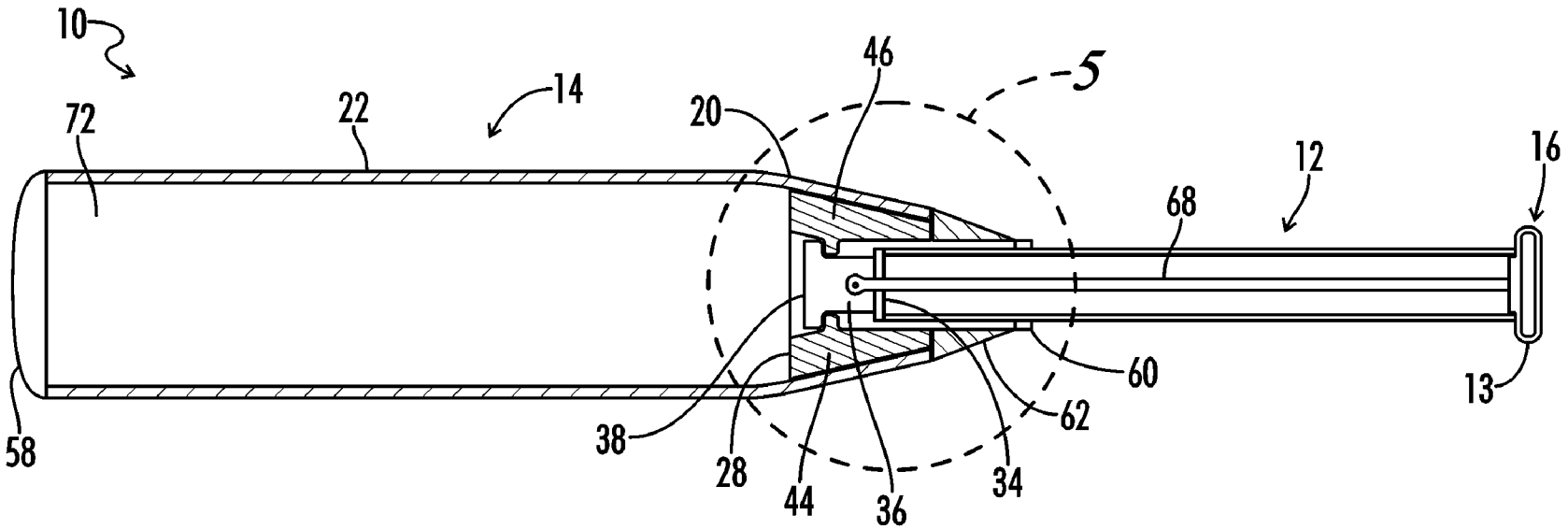
FIG. 4 is a cross sectional view taken along line 4-4 of FIG. 1.

Referring generally now to FIGS. 1-10, a bat for striking a ball having interchangeable parts is shown and generally designated by the numeral 10. The bat 10 comprises a handle section 12 and a striking section 14. The handle section 12, which can also be described as a handle 12, includes a first end 16 and a second end 18. The striking section 14, which can also be described as a contact portion 14, includes a tapered portion 20 and a barrel portion 22. The second end 18 of the handle section 12 is removably attached within the tapered portion 20. This removable attachment removably fixes the handle section 12 to the striking section 14 such that the bat 10 can be used to strike a ball and the handle section 12 and striking section 14 can be disassembled such that alternate handle sections and striking sections can be attached.

In a preferred embodiment, the striking section 14 is hollow and the barrel portion 22 includes a length 24 having a midpoint 26. The second end 18 of the handle section 12 terminates before the midpoint 26 of the length 24 of the barrel portion 22. Most preferably, the second end 18 of the handle section 12 terminates before the barrel portion 22. Alternately described, the second end 18 of the handle section 12 terminates near the connection between the taper portion 20 and the barrel portion 22.

The bat 10 further includes a fastening member 28, which can alternately be described as an insert 28, positioned in the tapered portion 20. The second end 18 also includes a connection element 30 engaging the fastening member 28 and removably attaching the striking section 14 to the handle section 12. A biasing member 32 is positioned on the handle section 12 proximate to the second end 18. The biasing member 32 is positioned to axially deflect the handle section 12 relative to the striking section 14, and more specifically to the tapered portion 20. An end cap 58 is positioned at the end of the striking section 14 opposite the tapered portion 20.

In a preferred embodiment, the tapered portion 20, which can also be described as a transition portion 20, is intrinsically connected with the barrel portion 22. This intrinsic connection can be described as the tapered portion 20 and barrel portion 22 cannot be attached to the handle section 12 independently of one another. In an alternate preferred embodiment, the tapered portion 20 is inseparable from the barrel portion 22 such that the tapered portion 20 and barrel portion 22 are parts of an indistinguishable whole striking section 14.

The connecting element 30, which can be described as a connecting member 30, includes a collar 34 and extension 36 and an expanded head 38. The collar 34, the extension 36, and the expanded head 38 each include a perimeter 35, 37 and 39 respectively wherein the perimeter 35 of the collar 34 and the perimeter 39 of the expanded head 38 are larger than the perimeter 37 of the extension 36.

This geometric configuration of the connecting element 30 facilitates the interaction of the connecting member 30 with the fastening member 28. Specifically, the fastening member 28 includes a proximal end 40 and a distal end 42 wherein the proximal end 40 is positioned between the first end 16 of the handle section 12 and the distal end 42 of the fastening member 28. The distal end 42 further includes notched sidewalls 44 and 46 defining a slotted opening 48 that interacts with the connecting element 30.

Figure 7:
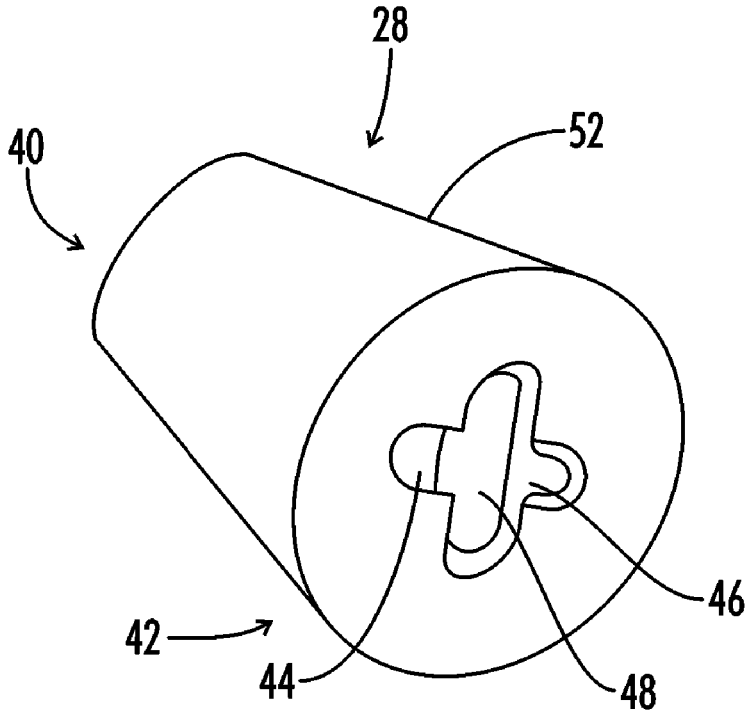
FIG. 7 is a perspective view of an alternate embodiment of the fastening member.
Figure 8:
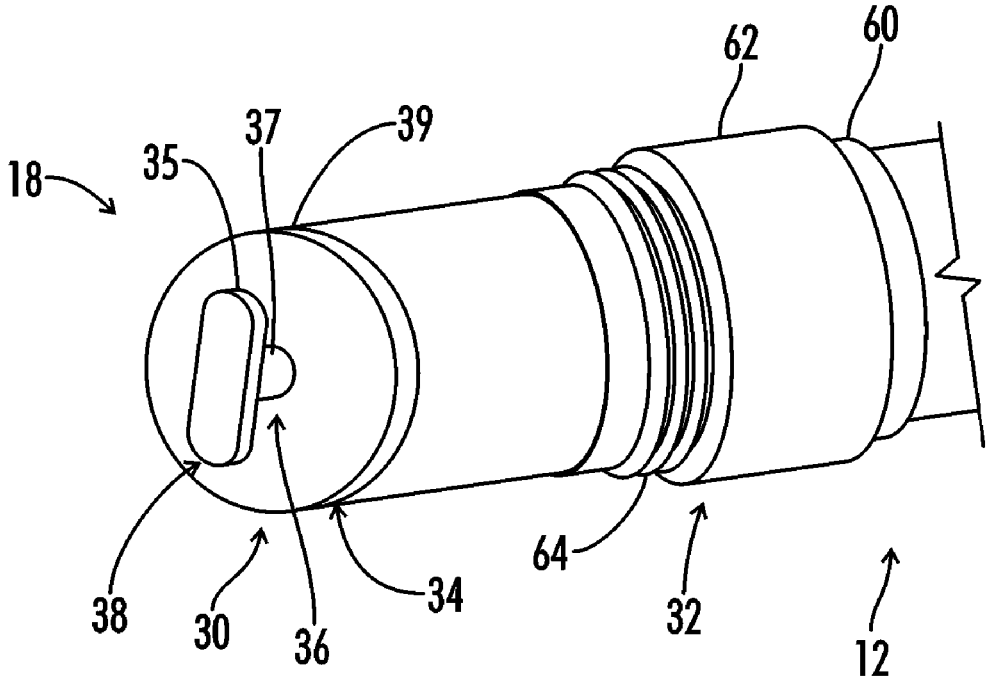
FIG. 8 is a detail view of an embodiment of the connecting element on the end of the handle section.

The slotted opening 48 accepts the extension 36 and expanded head 38 of the connecting element 30. The connected element 30 can then be rotated such that the expanded head 38 can be aligned with the notched sidewalls 44 and 46. Then the expanded head 38 can be positioned within the notched sidewalls 44 and 46 such that the connecting element 30 is rotatively fixed with respect to the fastening member 28. The ends of these elements are best seen in FIGS. 7 and 8 while the interaction can be seen in FIGS. 5-5B.

The expanded head 38 is shown with two armatures. However, the expanded head 38 can have numerous armatures and geometrical configurations to interact with a corresponding pattern of notched walls in the fastening member 28. For example, the expanded head 38 can be shaped with four armatures, in a clover leaf or cross pattern, that extend from the extension 36 and interact with four notched openings in the distal end 42 of the fastening member 28.

Preferably, the fastening member 28 is tapered and is frictionally fixed within the tapered portion 20. Alternately, the fastening member 28 can have a combination of tapered sides and straight sides corresponding to the joint of the tapered portion 20 and the barrel portion 22.

This frictional fixation of the fastening member 28 within the tapered portion 20 further facilitates the removable securement of the handle section 12 with respect to the striking section 14. Specifically, the tapered portion 20 can include a narrowing internal circumference 50 positioned distal from the barrel portion 22. The fastening member 28 can include a narrowing external circumference 52 shaped to correspond with the narrowing internal circumference 50 of the taped portion 20. As such, the fastening member 28 can be positioned along the slope of the tapered portion 20 and a proper amount of force can be used to frictionally secure and/or statically bind the fastening member 28 to the tapered portion 20 of the striking section 14.

Figure 9:
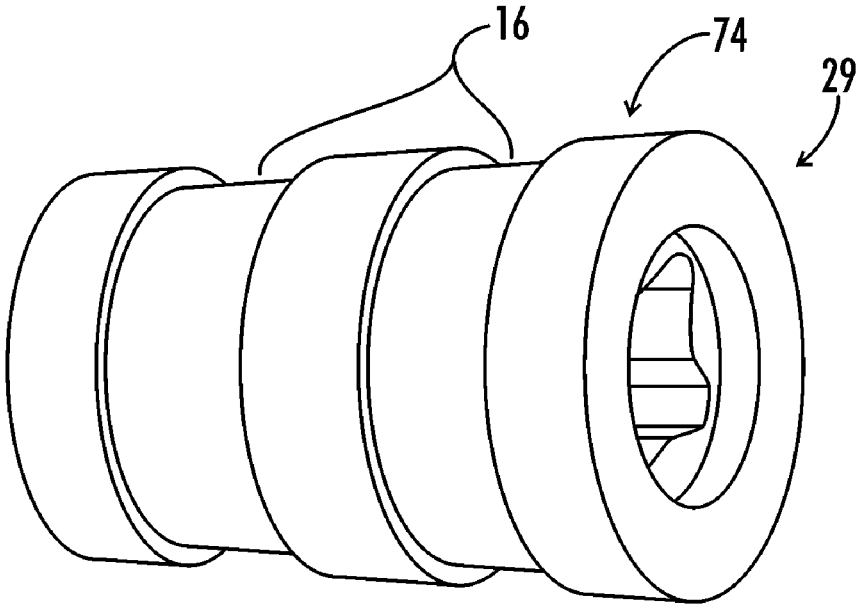
FIG. 9 is a perspective view of an alternate embodiment of the fastening member.
Figure 10:
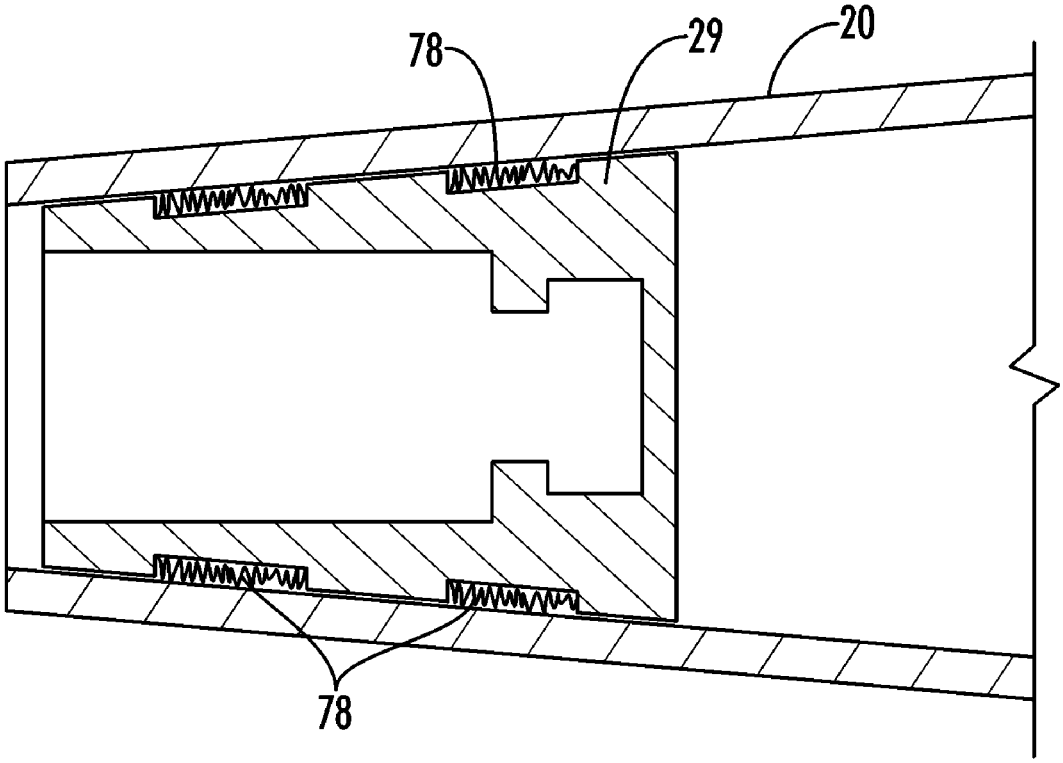
FIG. 10 is a cross-sectional view of the fastening member of FIG. 9 shown engaging the taper section.

Alternately, the fastening member can be secured in the tapered portion 20 by adhesion. For example, a fastening member 29 is shown in FIGS. 9-10 having a stepped external surface 74. The stepped external surface 74 creates various grooves 76 that facilitate the application of an adhesive 78. The adhesive 78 can fill the various grooves 76 of the stepped external surface 74 to secure the fastening member 29 to the tapered portion 20.

The tapered portion 20 includes a circumferential face 54, which can also be described as an external face 54, defining an opening 56 wherein the fastening member 28 is positioned within the opening 56. The fastening member 28 can be positioned along the length of the tapered portion 20 from the connection of the tapered portion 20 to the barrel portion 22 down to the end of the tapered portion 20 at the opening 56.

Figure 5A:
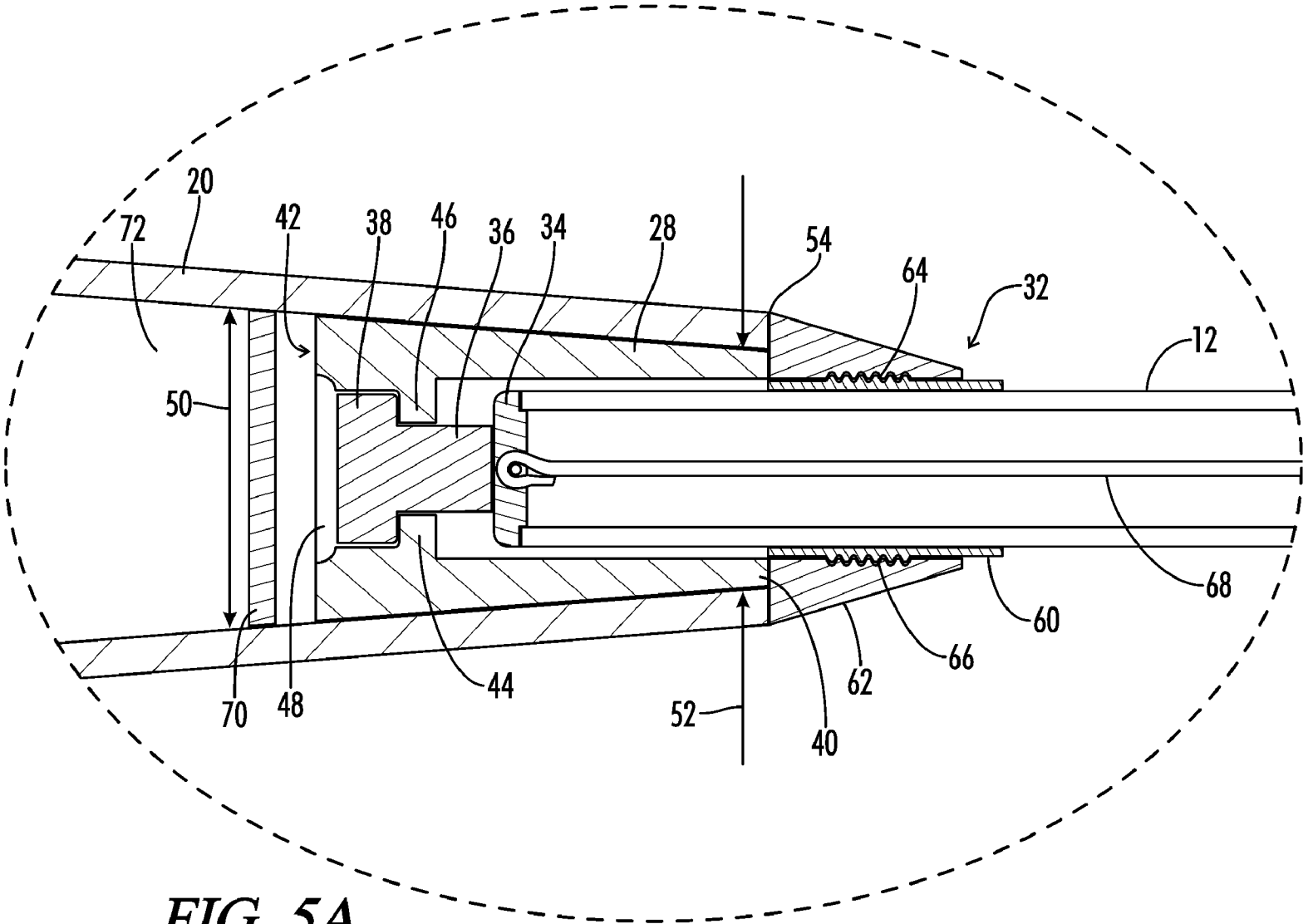
FIG. 5A is a detailed view of the area indicated as region 5 in FIG. 4.
Figure 5B:
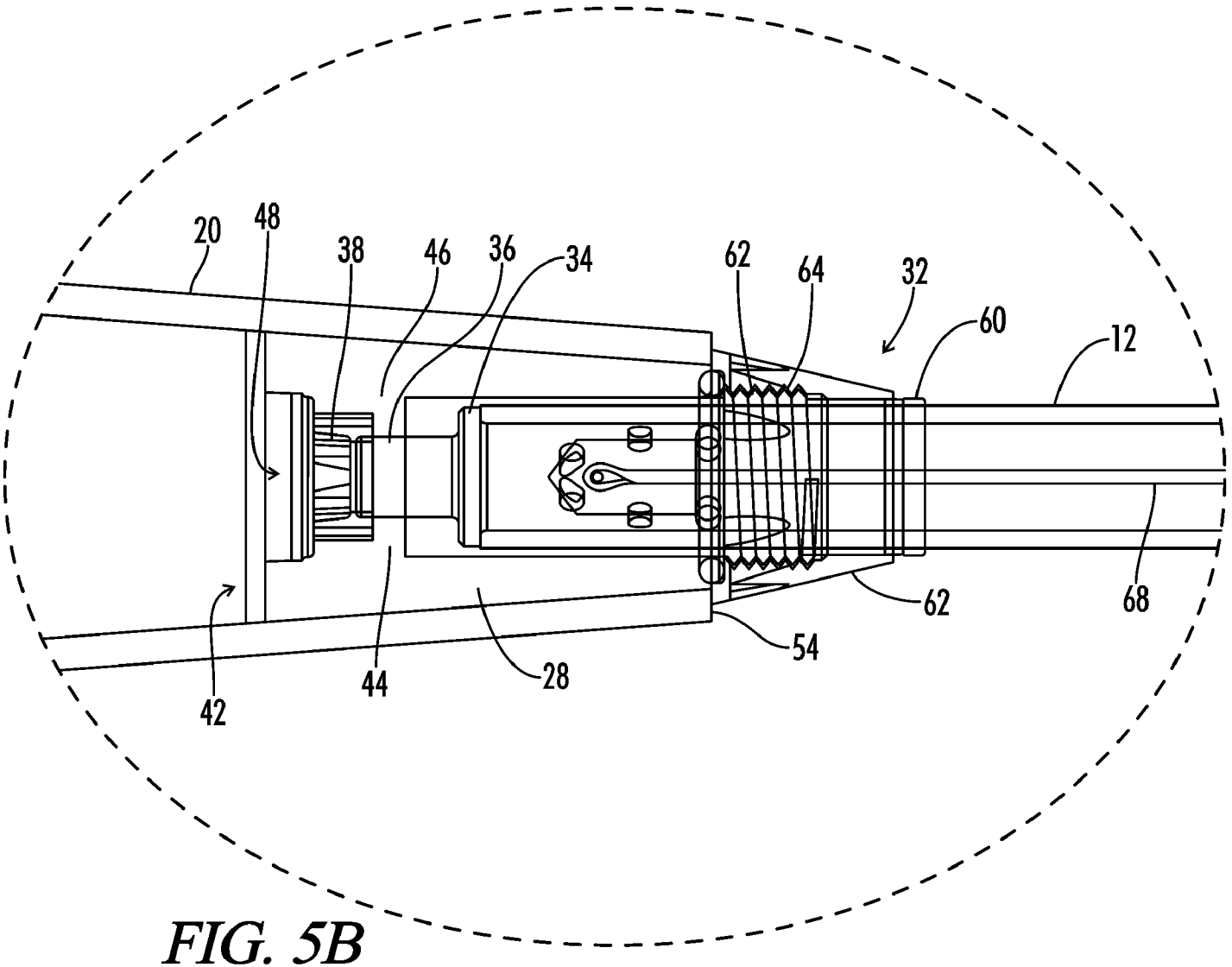
FIG. 5B is a phantom view of an alternate embodiment of the area indicated as region 5 in FIG. 4.
Figure 5C:
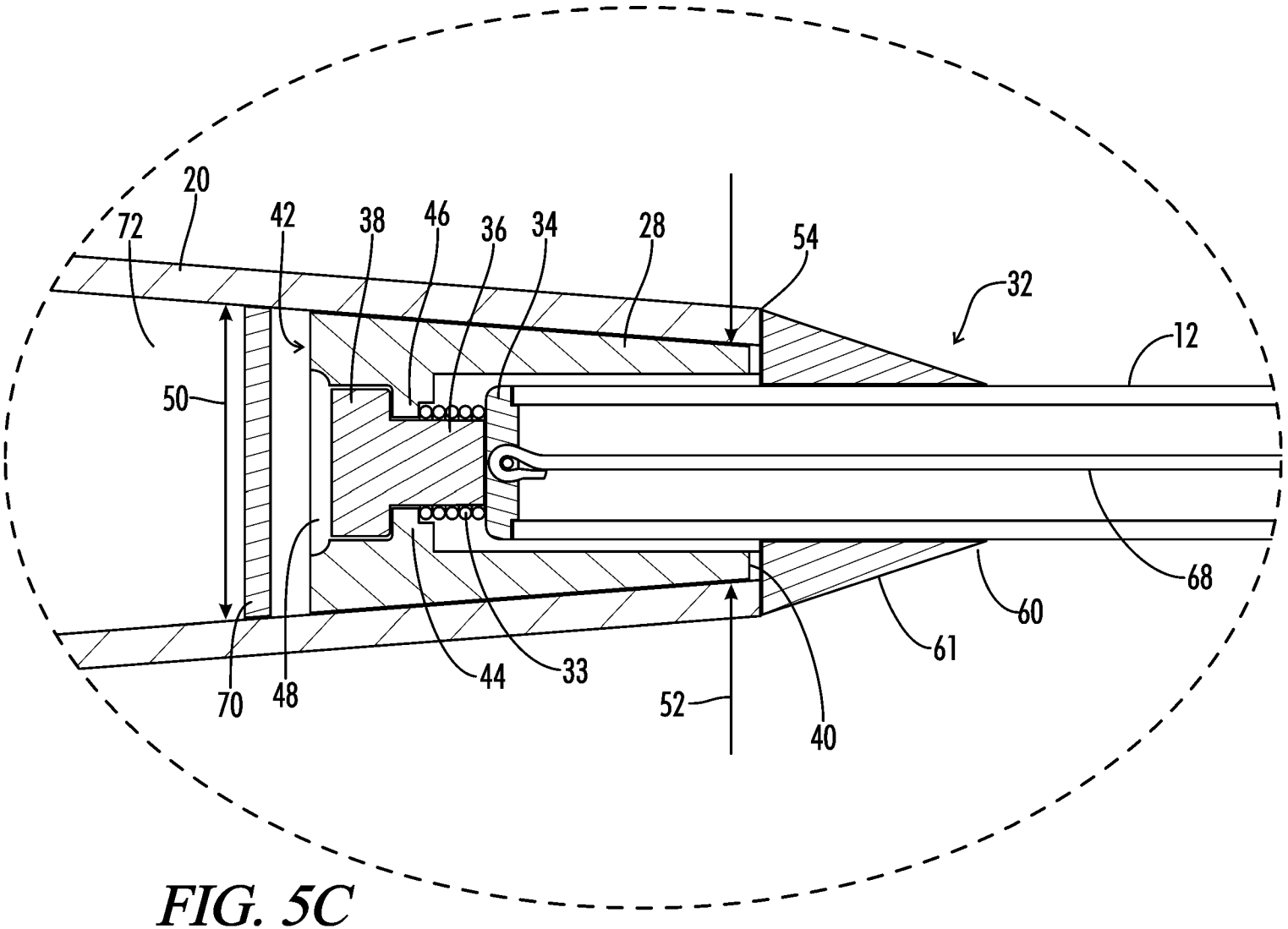
FIG. 5C is a detailed view of a second alternate embodiment of the area indicated as region 5 in FIG. 4.
Figure 6:
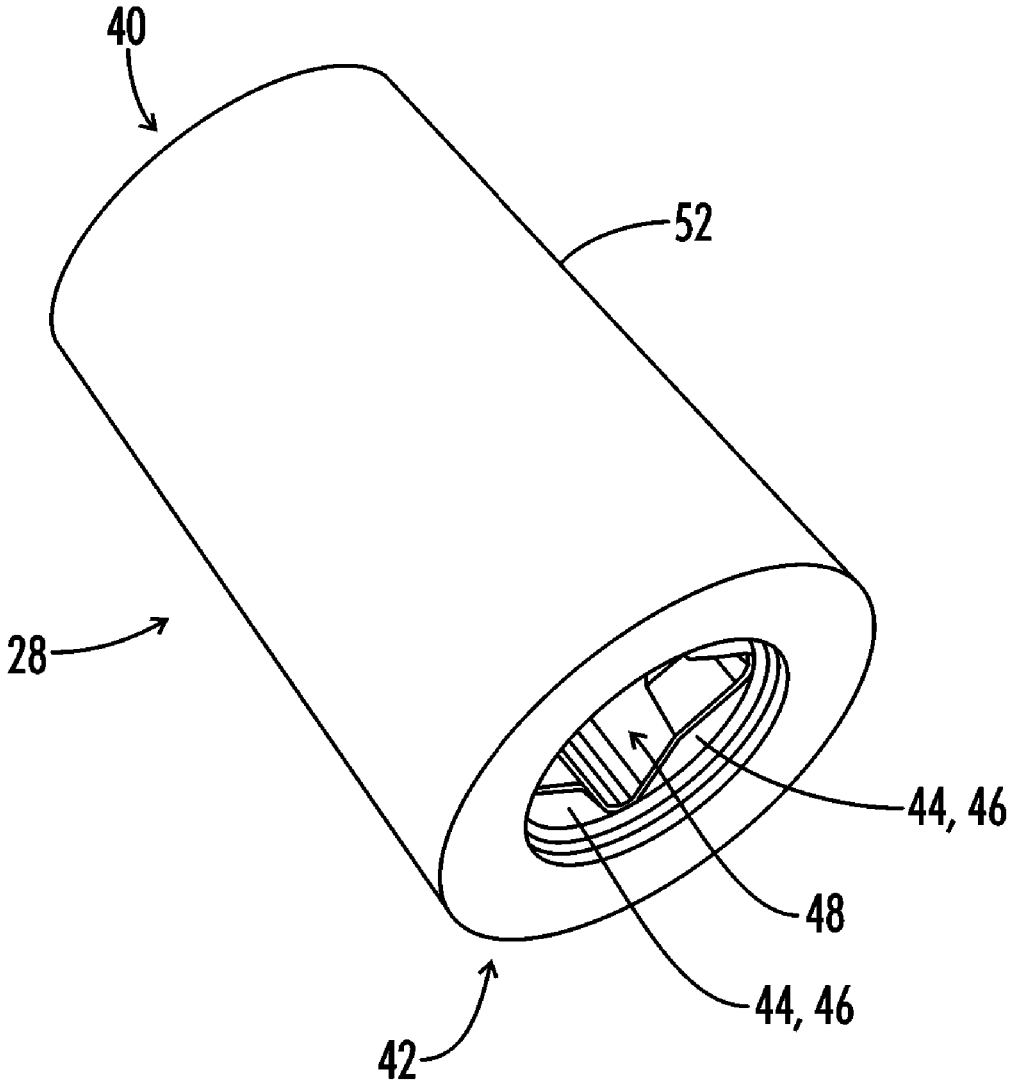
FIG. 6 is a perspective view of one embodiment of the fastening member.

Preferably, the proximal end 40 of the fastening member 28 is positioned inset from the circumferential face 54, seen in FIG. 5C. Alternately, the proximate end 40 can be positioned substantially flush with the circumferential face 54, seen in FIG. 5A. In this embodiment, the biasing member 32, which can also be described as a tightening member 32, abuts the proximal end 40 of the fastening member 28 and the circumferential face 54 of the tapered portion 20.

The biasing member 32 includes a sleeve 60 and a traveler 62. The sleeve 60 includes external threads 64 while the traveler 62 includes internal threads 66. The sleeve 60 is fixed to the handle section 12 while the traveler 60 can be displaced axially along the sleeve 60. The traveler 62 is positioned to engage the external face 54 of the tapered portion 20 after the connecting element 30 and fastening member 28 have been attached.

The rotating interaction between the sleeve and the traveler facilitates a transverse movement of the traveler axially with respect to the handle section 12. As such, the traveler engages the external face 54 and tightens the securement between the connecting element 30 and the fastening member 28. More specifically the engagement between the expanded head 38 and the notched sidewalls 44 and 46 is strengthened. This type of sturdy connection puts less stress than a purely threaded connection between elements of the bats as seen in the prior art. As such, a great majority of the stress incurred by the bat 10 during use is on more sturdy parts, such as the fastening member 20 and connecting element 30.

Alternately, the biasing member can be a spring-type element 33, as shown in FIG. 5C. The spring-type element 33 axially deflects the handle 12 with respect to the striking section 14. In this embodiment, the spring-type element 33 is positioned on the connecting element 30. Preferably, the spring-type element 33 surrounds the extension 36 of the connecting element 30 and engages, on one end of the spring-type element 33, the notched side walls 44 and 46 opposite the expanded head 38 and the collar 34 of the connecting element 30 on the other end of the spring-type element 33. The spring-type element 33 facilitates tension between the fastening member 28 and the connecting element 30 to secure the handle 12 to the striking portion 14. In this embodiment, a cover 61 can be positioned on the handle section 12 to aesthetically blend the taper portion 20 to the handle portion 12. Additionally, this embodiment also transfers more of the stress incurred by the bat 10 during use on the fastening member 20 and connecting element 30.

Also included is a safety chord 68 attached to the connecting element 30 and handle 12. The safety chord 68 is used to maintain a connection between the contact section 14 and the handle 12 in case of a failure in a portion of the handle 12. The safety chord 68 can be attached to various portions of the handle 12, including the handle stop 13 or handle end 13 positioned at the first end 16.

Also included is a locking mechanism 70 positioned proximate to the insert 28 in order to deter tampering with the bat 10. The locking mechanism 70 can be an integral part of the insert 28, as seen in FIG. 5B, or in the alternative, a separate piece spaced from the insert 28, as seen in FIG. 5A. The locking mechanism 70 facilitates the separation of the hollow portion 72 of the barrel portion 22 from exposure during the disconnection of the handle 12 from the contact section 14.

The bat 10 can also included various weight distributions and methods of weighting portions of the bat 10. For example, in a preferred embodiment additional weight can be added in the contact section 14. The weight can be added proximate to the end cap 58, or to the end cap 58, to facilitate a bat that is known in the art as an "end weighted bat". Additionally, weight can be added proximate to the insert 28, or to the insert 28, to counter the weight added proximate to the end cap 58 to facilitate a bat that is known in the art as a "balanced bat". For example, a polyurethane weight can be added, or a polyurethane coating can be applied to the insert 28 or the end cap 58 to facilitate this weight distribution.

Additionally, the contact section 14 can be made of many materials including, without limitation, metals, plastics, composites, polymer and carbine passed blends, and combinations thereof suitable for bat barrels.

Thus, although there have been described particular embodiments of the present invention of a new and useful Bat with Interchangeable Sections, it is not intended that such references be construed as limitations upon the scope of this invention except as set forth in the following claims.

What is claimed is:

1. An interchangeable bat comprising:

a handle including a first end and a second end, the second end including a connecting element;

a contact portion removably attached to the handle, the contact portion including a tapered portion intrinsically connected with a barrel portion;

a tapered fastening member positioned in the tapered portion, engaging the connecting element and removably fixing the contact portion to the handle;

a biasing member operatively engaging the connecting element of the handle and the tapered fastening member to axially deflect the handle away from the contact portion and the tapered fastening member; and a tapered cover positioned on the handle proximate to the connecting element and engaging the tapered portion.

2. The bat of claim 1, wherein the tapered fastening member includes proximal and distal ends, the distal end including notched side walls defining a slotted opening rotatively fixing the connecting element to the tapered fastening member.

3. The bat of claim 2, wherein the tapered portion includes an external face and the proximal end of the tapered fastening member is positioned inset from the external face.

4. The bat of claim 1, wherein the barrel portion includes a length having a mid-point and the second end of the handle terminates before the mid-point.

* * * * *